United States Patent [19]

Lee

[11] Patent Number: 4,592,673

[45] Date of Patent: Jun. 3, 1986

[54] DOUBLE-FRAMED "H" FORM NON-STOP ROADWAY INTERCHANGE

[76] Inventor: Soo-Yang Lee, No. 1307, Bldg. 16 Jangmi Apt. House, Jamsil 4-dong, Gangdong-Ku, Seoul, Rep. of Korea

[21] Appl. No.: 712,263

[22] Filed: Mar. 15, 1985

Related U.S. Application Data

[63] Continuation-in-part of Ser. No. 461,038, Jan. 26, 1983, abandoned.

[30] Foreign Application Priority Data

Jan. 27, 1982 [KR] Rep. of Korea ..... 595/82

[51] Int. Cl.[4] ..... E01C 1/04

[52] U.S. Cl. ..... 404/1

[58] Field of Search ..... 404/1; 14/1

[56] References Cited

U.S. PATENT DOCUMENTS

| | | | |
|---|---|---|---|
| 3,107,590 | 10/1963 | Cedeno | 404/1 |
| 3,386,351 | 6/1968 | Hara | 404/1 |
| 3,394,638 | 7/1968 | Burrell | 404/1 |
| 3,847,496 | 11/1974 | Stankiewicz | 404/1 |

FOREIGN PATENT DOCUMENTS

| | | | |
|---|---|---|---|
| 653322 | 3/1979 | U.S.S.R. | 404/1 |

OTHER PUBLICATIONS

A Policy on Arterial Highways in Urban Areas, American Association of State Highway Officials, Fig. J-1-9-a-, p. 511, copyright 1957.

*Primary Examiner*—James A. Leppink
*Assistant Examiner*—John F. Letchford
*Attorney, Agent, or Firm*—Michael N. Meller

[57] ABSTRACT

A traffic flow distribution interchange that provides non-stop and streamlined flow of freeway traffic along two crossing routes, and that occupies a relatively small amount of land area. The freeway interchange comprises a non-elevated route and an elevated crossing route which passes over the non-elevated route. Each route is substantially straight and provides traffic flow in two directions. The elevated and non-elevated routes are linked directly by four traffic flow paths along which vehicles can make right-hand turns from one route to the other. The elevated and non-elevated routes are linked indirectly by four additional traffic flow paths comprising configured ramps along which vehicles can make left-hand turns from one route to the other. These configured ramps pass under the elevated route and cross each other, providing unimpeded traffic flow.

6 Claims, 3 Drawing Figures

DOUBLE-FRAMED "H" FORM NON-STOP ROADWAY INTERCHANGE

RELATED APPLICATION

This is a continuation-in-part application derived from U.S. patent application Ser. No. 461,038, filed Jan. 26, 1983 now abandoned.

FIELD OF THE INVENTION

The present invention relates to a flyover roadway. In particular, it relates to a graded traffic flow distribution interchange which is ideally suited for enabling the smooth and non-stop flow of traffic at congested crossroads in a confined area.

BACKGROUND OF THE INVENTION

The modern-day problem of urban and suburban traffic congestion is a well-known phenomenon that takes place in countries all over the world. The root of the problem is grounded in the nature of surface travel along predetermined routes. At some point, two such predetermined routes must cross each other, usually at substantially right angles to one another.

At the point of intersection, only traffic flow along one of these routes can proceed at any given time. The common solution for maintaining an orderly flow of traffic has been the traffic light. Such a traffic light alternately signals the traffic along a particular route to proceed for a predetermined time and then to halt, at which time the traffic along the other route is allowed to proceed. This arrangement is further complicated by the need to allot time for some traffic along one route to turn left onto the other route, thereby changing this traffic's direction of travel. During the time in which such turns are being made, the remaining traffic is stationary. The result of having such complicated timing patterns for the signals at a congested intersection is inefficient cross-flow of traffic and long delays as the traffic backs up, for example, during rush hours.

The conventional solution to the problem posed by the crossing of two traffic routes is to elevate one of the routes, allowing the other route to pass underneath. This arrangement is an improvement because it solves the problem of two crossing flows of traffic by allowing both to proceed simultaneously instead of alternately. Thus, more time is allotted for the flow along each route, thereby allowing an increased volume of traffic along each route.

The elevation of one of the routes does not solve the problem presented, however, by traffic that flows along one route and then turns left onto the second intersecting route. For example, turning vehicles traveling along the non-elevated or ground route must exit, proceed up a graded ramp, halt at the point of entry of the elevated route or overpass, and await a signal before proceeding to turn left onto the elevated route. Likewise, turning vehicles traveling along the elevated route must halt at the point of exit of the elevated route, await a signal before turning left, and then proceed down a graded ramp and onto the non-elevated route. All vehicles as a result must await the precedence indicated by traffic signals. Naturally, because all traffic is not moving simultaneously, such elevated bridges fail to eliminate the stoppages and delays attributable to traffic congestion.

The above-noted problem is in turn solved by the diamond- or clover-shaped interchange. According to the clover-shaped arrangement, for example, vehicles which are proceeding along the unelevated route and which wish to turn left onto the elevated route must turn right and exit up a graded ramp which has a loop configuration. The exiting vehicle approaches this point of exit after passing under the elevated bridge of the crossing route. After exiting, the vehicle proceeds along the looped ramp, which connects the point of exit of the unelevated route with the point of entry of the elevated route. At the point of entry onto the elevated route, the vehicle merges into the traffic flow along the elevated route without coming to a halt. According to such a clover-shaped arrangement, all traffic moves continously and simultaneously.

This type of traffic flow distribution interchange is disadvantageous, however, in that the interchange configuration requires a large amount of land area and thus, is costly to construct. For example, the loops comprising the clover-shaped interchange have a large radius, utilize large amounts of construction materials, and require expensive grading and excavation. Therefore, diamond-and clover-shaped interchanges are unsuitable for use in the confined areas typical of metropolitan environments.

SUMMARY OF THE INVENTION

The present invention is designed to solve the above-noted problems. The invention comprises a traffic flow distribution interchange that provides non-stop flow of freeway traffic along two crossing routes, and yet can be constructed so as to occupy a relatively small amount of land area. The interchange according to the present invention comprises a non-elevated route and an elevated crossing route which passes over the non-elevated route, each straight route providing traffic flow in two directions. The elevated and non-elevated routes are linked directly by four sections of road that provide paths along which vehicles can make right-hand turns from one route onto the other route. The elevated and non-elevated routes are linked indirectly by four configured ramps that provide paths along which vehicles can make left-hand turns from one route onto the other route. In both cases, the configuration of the interchange according to the present invention enables the turns to be made without stoppage of traffic, unless, of course, a momentary pause is required prior to merging with the flow of oncoming traffic.

BRIEF DESCRIPTION OF THE DRAWINGS

The traffic flow distribution interchange according to the present invention will be described in detail with reference to the following drawings.

DETAILED DESCRIPTION OF THE PREFERRED EMBODIMENT

Figure 1:
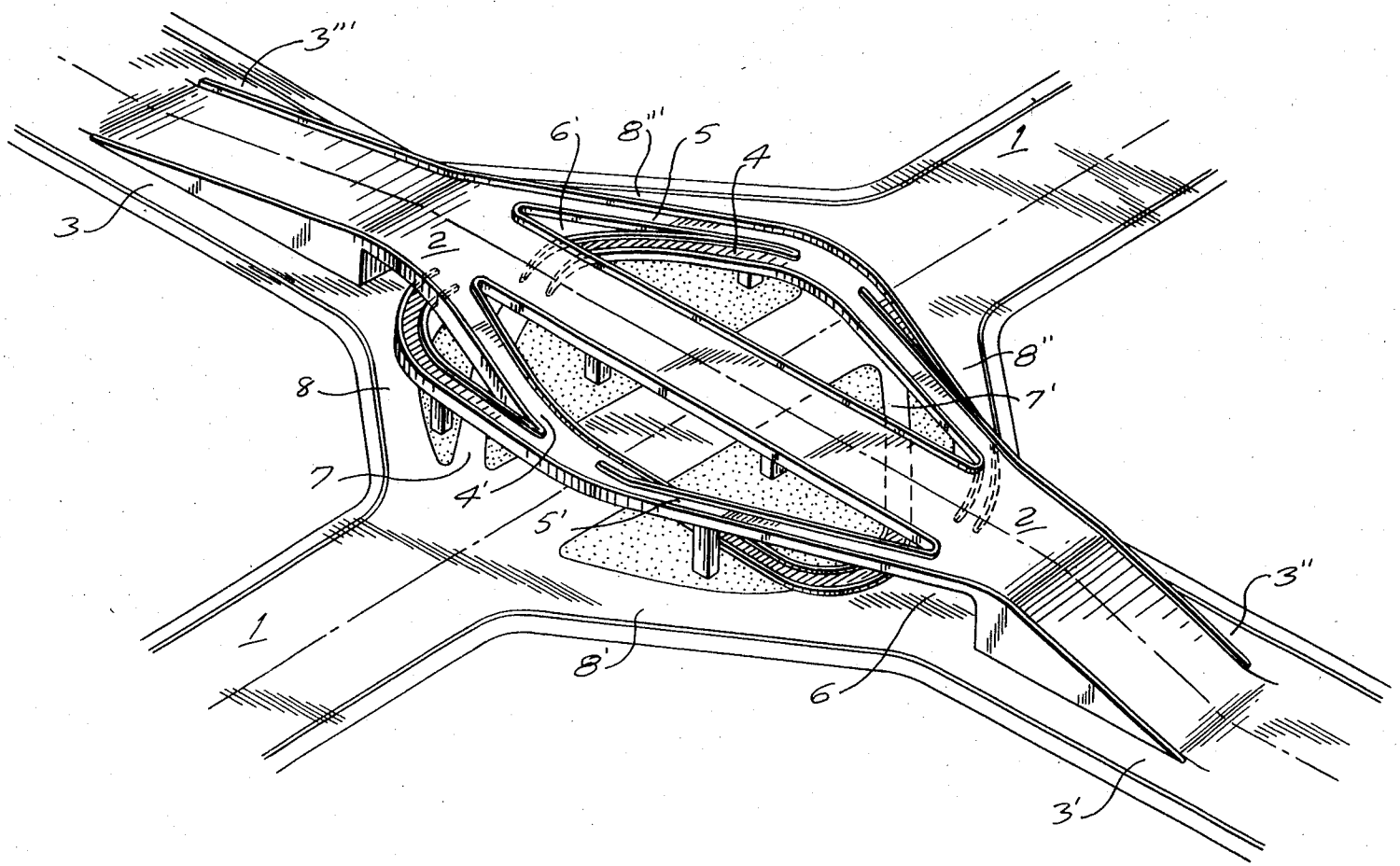
FIG. 1 shows a perspective view of the present invention.

FIG. 1 shows the preferred embodiment of the interchange configuration according to the present invention. The non-elevated route 1 is a substantially straight road with a predetermined number of traffic lanes. The elevated route 2 passes over the non-elevated route 1 and is also a substantially straight road with a predetermined number of traffic lanes.

In the preferred embodiment the straight lines defined by routes 1 and 2 cross at an angle such that they are substantially mutually perpendicular. However, it is obvious to one skilled in the art that the crossing routes need not be mutually perpendicular.

Figure 2:
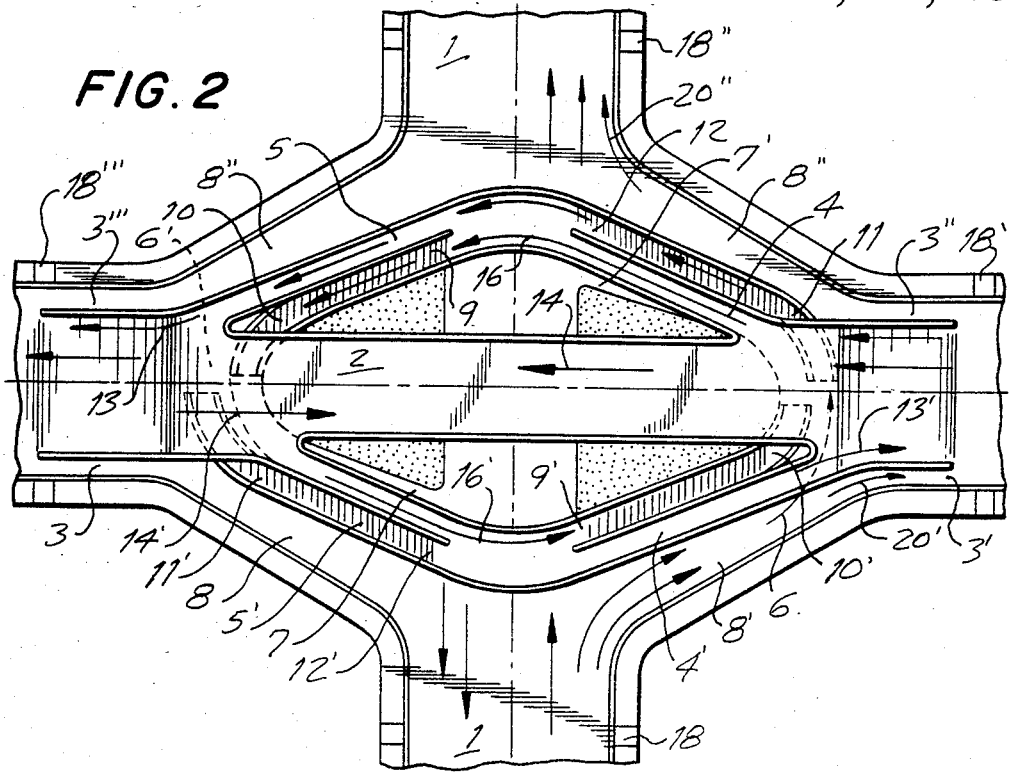
FIG. 2 shows a plan view of the present invention.

The geometrical layout of the interchange of the present invention can be seen clearly in the plan view of FIG. 2. The elevated route 2 comprises a pair of graded road sections connected by a level elevated road section (as can be seen clearly in FIG. 1). Four separate ramps 4, 4' and 5, 5' connect the level elevated road section of elevated route 2 with the terrain of non-elevated route 1. Each ramp comprises a level straight ramp section connected to the level elevated road section of elevated route 2 and forming an angle therewith, a level curved ramp section connected to the level straight ramp section and overlying the non-elevated route, a graded straight ramp section connected to the curved level ramp section, and a graded curved ramp section connected to the graded straight section and partly underlying the elevated route 2. The angle between the respective level straight ramp sections and the level elevated road section of elevated route 2 is adapted for merging and diverging traffic, and ideally is 25°–35°.

Each side of the level elevated road section of elevated route 2 has two ramps connected therewith. The level curved ramp sections of each pair of ramps are contiguous. However, for each pair of ramps the respective level straight ramp sections extend on opposite sides of non-elevated route 1, as do the respective graded straight and curved ramp sections.

The interchange according to the present invention is designed to occupy a relatively small amount of surface area as compared to known interchanges. This is accomplished by arranging the ramps of each pair so that their vertical projections are substantially adjacent along the respective pairs of straight ramp sections. For each pair of adjacent ramps, the vertical projection of the level straight ramp section of one ramp is parallel and adjacent to the vertical projection of the graded straight ramp section of the other ramp, and the vertical projection of the graded straight ramp section of said one ramp is parallel and adjacent to the vertical projection of the level straight ramp section of said other ramp.

The extended vertical projections of the straight ramp sections of each ramp form the sides of an isosceles triangle with the vertical projection of the level elevated road section of elevated route 2 defining the base of this isosceles triangle. The respective isosceles triangles of the ramp pairs are congruent.

This ramp layout enables the surface area occupied by the interchange to be minimized. This reduced surface area results from several distinctive features of the present invention. First, the merging and diverging ramps, i.e., the level straight ramp sections, are connected to the level elevated road section of elevated route 2, preferably forming an angle therewith of 30°±5°. Second, the respective ramps of each pair are arranged so that their vertical projections are adjacent throughout their entire extent except for along the graded curved ramp sections of the respective ramps. Furthermore, the contiguous level curved ramp sections on each side of the elevated route 2 and overlying the non-elevated route 1 are separated from the level elevated road section of the elevated route by a distance which is less than the width of said elevated route.

Both the non-elevated 1 and the elevated 2 routes are bisected so as to allow traffic flow in opposite directions. Side roads 3, 3', 3'', and 3''' run alongside and parallel to the graded embankments of elevated route 2. The elevated route 2 is indirectly linked to non-elevated route 1 by means of ramps 4 and 4'. The non-elevated route 1 is indirectly linked to elevated route 2 by means of ramps 5 and 5'. The paths 6 and 6', located under elevated route 2, lead to the ends of ramps 5 and 5', respectively. The paths 7 and 7' link the ends of ramps 4 and 4', respectively, with the non-elevated route 1. The paths 8, 8', 8'', and 8''' link the non-elevated route 1 with side roads 3, 3', 3'', and 3''', respectively.

As shown in FIG. 2, the ramps 4 and 4' are elevated at the same elevation as the elevated route 2 up to points 9 and 9', respectively. Thereafter, the ramps are descending from points 9 and 9' to points 10 and 10', respectively. Points 10 and 10' are at substantially the same elevation as non-elevated route 1, although this is by no means required since small gradations in terrain pose no problem. Ramps 5 and 5' are ascending from points 11 and 11' to points 12 and 12', respectively. Beyond points 12 and 12', ramps 5 and 5' respectively, are at substantially the same elevation as elevated route 2. The height of the elevated route 2 and the grades of the ascending and descending ramps are dictated according to the specific conditions of the terrain, but at a minimum the height of the overpass must be sufficient to allow vehicles of maximum height to pass underneath the overpass via non-elevated route 1.

It will also be noted that ramps 4 and 4' are contiguous with and parallel to ramps 5 and 5' at the points directly above the non-elevated route 1. The respective ramps are joined at these points, allowing access from one ramp to the other. This is advantageous in two cases. In the first case, if a driver traveling along elevated route 2 has exited along ramp 4 by mistake, the driver can direct his vehicle off at ramp 4 and onto ramp 5. Ramp 5 rejoins elevated route 2, thereby allowing the driver to continue in his original direction of travel without great inconvenience. In the second case, if a driver traveling along non-elevated route 1 wishes to make a U-turn, the driver, for example, can exit along path 8', enter ramp 5 via path 6, and at the point of access between ramps 4 and 5, can drive his vehicle from ramp 5 to ramp 4, and then back onto non-elevated route 1 via path 7, thereby completing the U-turn.

Figure 3:
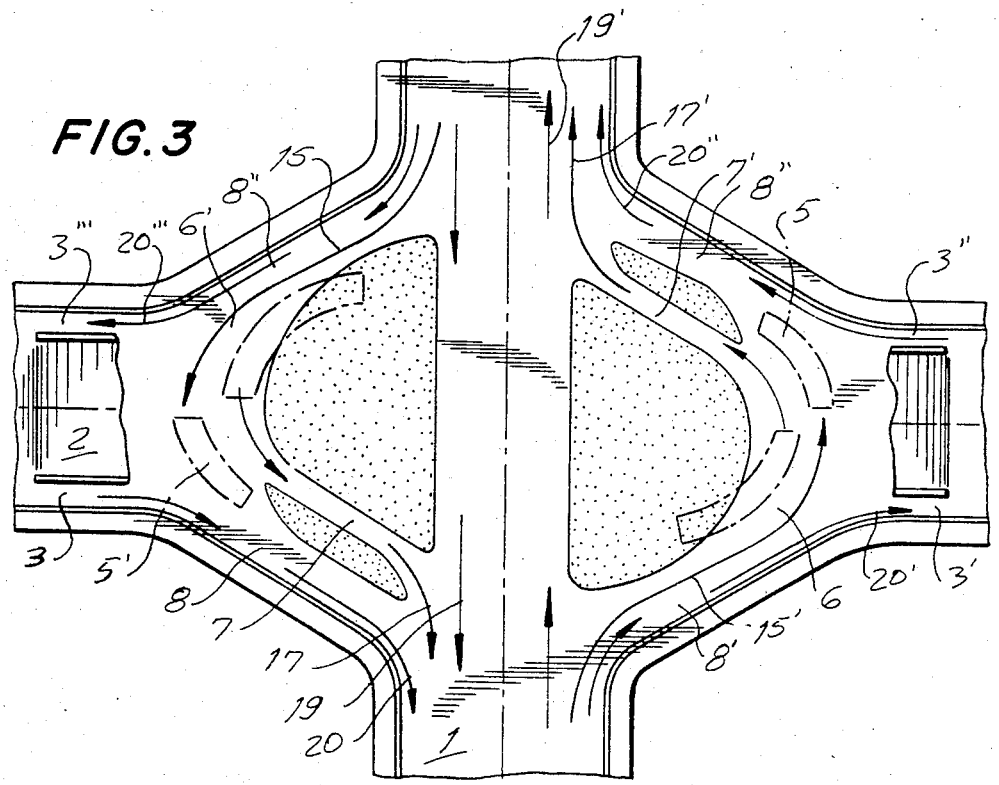
FIG. 3 shows a plan view of the present invention with the configured ramps and a portion of the elevated route eliminated.

FIGS. 2 and 3 illustrate the traffic flow pattern in an interchange configuration according to the present invention. Traffic flows along elevated route 2 in opposite directions 14 and 14'. Traffic flows along non-elevated route 1 in opposite directions 19 and 19'. The portions of the flows along elevated route 2 which want to make a left-hand turn onto non-elevated route 1 are diverted along ramps 4 and 4' and merge with flows 19 and 19' or flows 17 and 17' via paths 7 and 7' respectively. The portions of the flows along elevated route 2 which want to make a right-hand turn onto non-elevated route 1 are diverted along side roads 3 and 3'' to paths 8 and 8'', respectively. The flows 20 and 20'' along paths 8 and 8'', respectively, merge with flows 17, 19 and 17', 19', respectively.

The portions of the traffic flows along non-elevated route 1 which want to make a left-hand turn onto elevated route 2 are diverted along paths 8' and 8''' to paths 6 and 6', respectively, and then onto ramps 5 and 5', respectively. The flows 13 and 13' along ramps 5 and 5' merge with flows 14 and 14', respectively. The portions of the flows along non-elevated route 1 which want to make a right-hand turn onto elevated route 2 are diverted onto paths 8' and 8''' and then onto side roads 3' and 3''', respectively. The flows 20' and 20''' along side roads 3' and 3''' merge with flows 14' and 14, respectively.

The present invention is intended for use in confined and congested areas, particularly metropolitan areas. Naturally, it is expected that pedestrians will be present in the area of the interchange. Therefore, it is advantageous to provide pedestrian walkways alongside routes 1 and 2 and alongside paths 8. These pedestrian walkways can be connected via elevated pedestrian bridges 18, 18', 18'', and 18''', shown in FIG. 2. Pedestrian bridges 18 and 18'' pass over non-elevated route 1, and pedestrian bridges 18' and 18'' pass over elevated route 2 at a point where elevated route 2 is no longer elevated.

Thus, the preferred embodiment of the interchange configuration according to the present invention allows right- and left-hand turns to be made at the crossing of two substantially perpendicular routes continuously and simultaneously, without interruption of the traffic flow. This flyover configuration of the crossing eliminates the problems associated with the conventional intersections, at which turning traffic and straight-through traffic flow alternately according to a predetermined pattern of traffic control. The delay that invariably attends intersections with high traffic volume is eliminated by the interchange configuration according to the present invention. Traffic signals are eliminated and all traffic flows continuously. Such a traffic flow distribution interchange offers the additional advantages of reduced risk of traffic accidents and the elimination of traffic police at the crossing. This is a direct result of the streamlined traffic flow of the present invention and the elimination of vehicles crossing at the same point from different directions.

What is claimed is:

1. A roadway interchange for connecting first and second roadways, comprising (a) a level elevated road section overlying said first roadway, (b) first and second graded road sections connecting said level elevated road section with respective non-elevated portions of said second roadway disposed on either side of said first roadway, (c) first through fourth level curved ramp sections overlying said first roadway, said first and second level curved ramp sections being arranged adjacent to each other on one side of said second roadway, said third and fourth level curved ramp sections being arranged adjacent to each other on the other side of said second roadway, (d) first through fourth level straight ramp sections, said first and third level straight ramp sections being arranged on one side of said first roadway and connecting said first and third level curved ramp sections respectively with said level elevated road section, and said second and fourth level straight ramp sections being arranged on the other side of said first roadway and connecting said second and fourth level curved ramp sections respectively with said level elevated road section, (e) first through fourth graded curved ramp sections, each of said graded curved ramp sections partly underlying said level elevated road section, and (f) first through fourth graded straight ramp sections, said second and fourth graded straight ramp sections being arranged on said one side of said first roadway and connecting said second and fourth level curved ramp sections respectively to said second and fourth graded curved ramp sections respectively, and said first and third graded straight ramp sections being arranged on said other side of said first roadway and connecting said first and third level curved ramp sections respectively to said first and third graded curved ramp sections respectively, wherein the vertical projections of said first level straight ramp section and said second graded straight ramp section are substantially parallel, the vertical projections of said first graded straight ramp section and said second level straight ramp section are substantially parallel, the vertical projections of said third level straight ramp section and said fourth graded straight ramp section are substantially parallel, and the vertical projections of said fourth level straight ramp section and said third graded straight ramp section are substantially parallel.

2. The roadway interchange of claim 1, wherein said first and second level curved ramp sections are contiguous, and said third and fourth level curved ramp sections are contiguous.

3. The roadway interchange of claim 1, further comprising first through fourth unelevated road sections connecting said first and second roadways.

4. The roadway interchange of claim 2, wherein said second and third level curved ramp sections are separated from said level elevated road section by a distance less than the width of said unelevated portions of said second roadway.

5. The roadway interchange of claim 3, further comprising fifth through eighth unelevated road sections connecting said first roadway to said first through fourth graded curved ramp sections respectively.

6. The roadway interchange of claim 3, further comprising first through fourth elevated pedestrian bridges connected by sidewalks, said first and second pedestrian bridges spanning said first roadway, and said third and fourth pedestrian bridges spanning said unelevated portions of said second roadway, said pedestrian bridges and connecting sidewalks forming a footpath which circumambulates said interchange.

* * * * *